US009557691B2

(12) United States Patent
Tokunaga et al.

(10) Patent No.: US 9,557,691 B2
(45) Date of Patent: Jan. 31, 2017

(54) FIXING DEVICE TEMPERATURE SENSOR

(71) Applicant: KYOCERA Document Solutions Inc., Osaka (JP)

(72) Inventors: Ryohei Tokunaga, Osaka (JP); Tatsuya Yamanaka, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/962,189

(22) Filed: Dec. 8, 2015

(65) Prior Publication Data

US 2016/0179042 A1 Jun. 23, 2016

(30) Foreign Application Priority Data

Dec. 17, 2014 (JP) ..... 2014-255066

(51) Int. Cl.
*G03G 15/00* (2006.01)
*G03G 15/20* (2006.01)

(52) U.S. Cl.
CPC ..... *G03G 15/2039* (2013.01); *G03G 15/2064* (2013.01)

(58) Field of Classification Search
CPC G03G 15/2039; G03G 15/2053; G03G 15/20; G03G 15/2028; G03G 2215/2016; G03G 2215/2032
USPC ..... 399/69, 122
See application file for complete search history.

(56) References Cited

U.S. PATENT DOCUMENTS 5,999,768 A * 12/1999 Gillen ..... G01J 5/0003 374/121
2006/0233565 A1* 10/2006 Tamaoki ..... G03G 15/2039 399/96
2007/0095820 A1* 5/2007 Kinouchi ..... H05B 6/145 219/619
2012/0219312 A1* 8/2012 Yuasa ..... G03G 15/2039 399/69

FOREIGN PATENT DOCUMENTS

JP 2003-029571 1/2003
JP 2004-045330 2/2004

* cited by examiner

*Primary Examiner* — Walter L Lindsay, Jr.
*Assistant Examiner* — Jessica L Eley
(74) *Attorney, Agent, or Firm* — Wenderoth, Lind & Ponack, L.L.P.

(57) ABSTRACT

The fixing unit has a housing that has a heating roller and a pressing roller accommodated therein. A temperature detection sensor and a sensor board are provided outside the housing. An image forming apparatus includes a sensor protection tube. The sensor protection tube includes a hollow cylindrical body passing through a side wall portion of the housing. One end of the sensor protection tube abuts a mounting surface of the temperature detection sensor in the sensor board so as to surround a periphery of the temperature detection sensor. The other end of the sensor protection tube is positioned in the housing.

4 Claims, 3 Drawing Sheets

FIXING DEVICE TEMPERATURE SENSOR

CROSS-REFERENCE TO RELATED APPLICATION

This application is based upon and claims the benefit of priority from Japanese Patent Application No. 2014-255066 filed on Dec. 17, 2014, the entire contents of which are incorporated herein by reference.

BACKGROUND

The technology of the present disclosure relates to an image forming apparatus.

In general, a fixing device mounted in an electrophotographic image forming apparatus is provided with a temperature detection sensor for detecting the surface temperature of a heating roller. As a detection system of the temperature detection sensor, two kinds of a contact type and a non-contact type have been known. In the contact type temperature detection sensor, a thermistor is made contact with the surface of the heating roller to detect the surface temperature of the roller. Therefore, the surface of the heating roller may be damaged by the thermistor. On the other hand, in the non-contact type temperature detection sensor, since the sensor needs not to be made to directly contact with the heating roller, the surface of the heating roller is not damaged. However, in the non-contact type temperature detection sensor, there is a problem that dust such as toner and paper dust is attached to a temperature detection surface and detection accuracy is reduced.

In order to solve such a problem, a technology of performing fluorine coating on the surface of the temperature detection surface has been proposed. In this way, although contamination has been attached to the temperature detection surface of the temperature detection sensor for example, it is possible to remove the contamination by simple cleaning work.

Furthermore, an image forming apparatus configured such that the temperature detection sensor is covered by a box-like cover member has been proposed. The air in the cover member is sucked by a suction fan. In this way, since the pressure in the cover member becomes a positive pressure (higher than the atmospheric pressure), it is possible to prevent dust from being attached to the temperature detection sensor.

SUMMARY

An image forming apparatus according to one aspect of the present disclosure includes a fixing unit, a temperature detection sensor, and a sensor board. The fixing unit has a heating roller and a pressing roller arranged while interposing a paper conveyance path therebetween. The fixing unit performs a fixing process on a paper at a fixing nip portion formed by the aforementioned heating roller and the aforementioned pressing roller. The temperature detection sensor is a non-contact type sensor. The temperature detection sensor has a temperature detection surface facing a surface of the aforementioned heating roller while being spaced apart from the surface of the aforementioned heating roller. The sensor board is a board on which the temperature detection sensor is mounted.

The aforementioned fixing unit includes a housing. The housing has the heating roller and the pressing roller accommodated therein. The aforementioned temperature detection sensor and the sensor board are provided outside the aforementioned housing. The aforementioned image forming apparatus further has a sensor protection tube. The sensor protection tube includes a hollow cylindrical body passing through a side wall portion of the aforementioned housing. One end of the sensor protection tube abuts a mounting surface of the temperature detection sensor in the aforementioned sensor board so as to surround a periphery of the temperature detection sensor. The other end of the sensor protection tube is positioned in the aforementioned housing.

DETAILED DESCRIPTION

Figure 1:
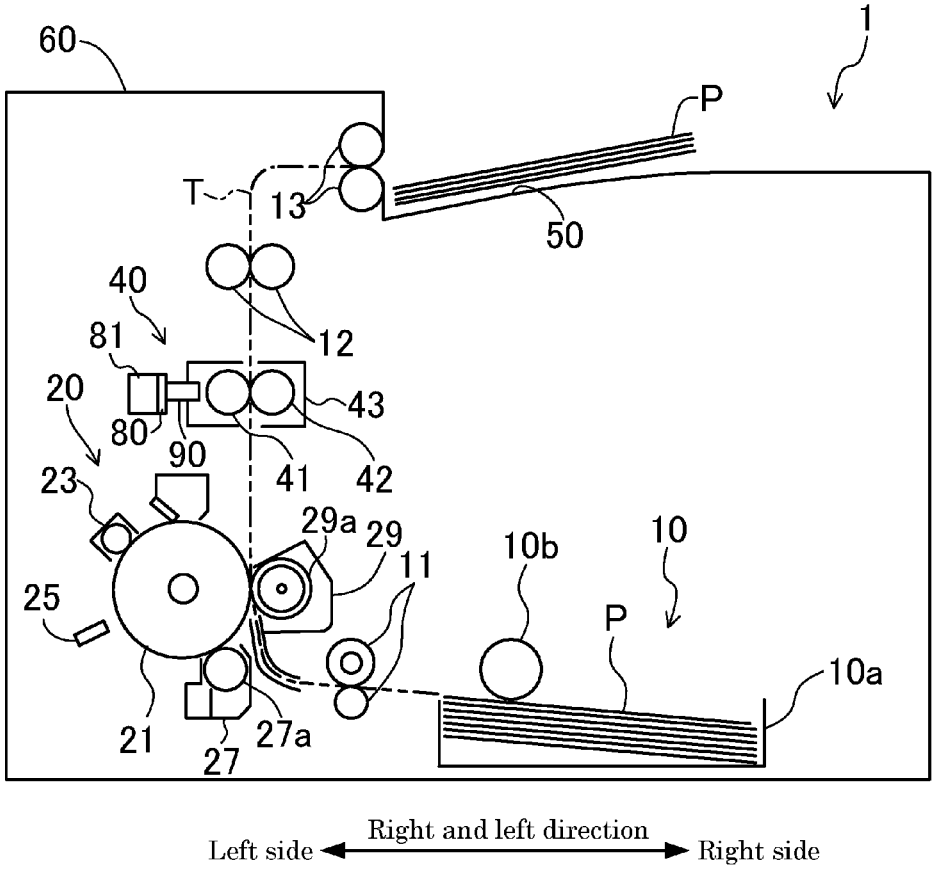
FIG. 1 is a schematic diagram illustrating an internal structure of an image forming apparatus according to an embodiment.

FIG. 1 illustrates an image forming apparatus 1 in the present embodiment. The image forming apparatus 1 includes a monochrome laser printer in the present embodiment. In the following description, a "front side" and a "rear side" indicate a "front side" and a "rear side" (a front side and a back side in a direction perpendicular to the paper surface of FIG. 1) of the image forming apparatus 1, and a "left side" and a "right side" indicate a "left side" and a "right side" when the image forming apparatus 1 is viewed from the front side.

The aforementioned image forming apparatus 1 has a paper feeding unit 10, an image forming unit 20, a fixing unit 40, a paper discharge unit 50, and a casing 60. On a paper conveyance path T from the paper feeding unit 10 to the paper discharge unit 50, a plurality of conveying roller pairs 11 to are arranged to convey a paper P while interposing it therebetween. The aforementioned paper feeding unit 10 is arranged at a lower portion of the casing 60. The paper feeding unit 10 has a paper feeding cassette 10*a* in which the paper P having a sheet shape is accommodated, and a pick-up roller 10*b* for taking out the paper P in the paper feeding cassette 10*a* and sending out the paper P to an exterior of the cassette. The paper P sent out to the exterior of the cassette from the paper feeding cassette 10*a* is supplied to the image forming unit 20 via the conveying roller pair 11.

The image forming unit 20 has a photosensitive drum 21, a charging device 23, an exposure device 25, a developing device 27, a transfer device 29, and a toner container (not illustrated). In the image forming unit 20, the peripheral surface of the photosensitive drum 21 is electrified by the charging device 23, and then laser light based on document image data (for example, image data of a document image received from an external terminal) is irradiated to the surface of the photosensitive drum 21 by the exposure device 25, so that an electrostatic latent image is formed. The electrostatic latent image formed (carried) on the surface of the photosensitive drum 21 is developed by the developing device 27 as a toner image. The toner image developed by the developing device 27 is transferred to the paper P supplied from the paper feeding unit 10 by the transfer device 29. The paper P after the transfer is supplied to the fixing unit 40 by a transfer roller 29*a* of the transfer device 29 and the photosensitive drum 21.

The fixing device 40 has a heating roller 41 and a pressing roller 42 brought into press-contact with the heating roller 41 with predetermined pressing load. A halogen lamp (not illustrated) serving as a heating means is arranged inside the heating roller 41. The peripheral surface of the heating roller 41 is heated by heat generated from the halogen lamp. At a lateral side of the heating roller 41, a temperature detection sensor 70 for detecting the temperature of the peripheral surface of the heating roller 41 is arranged. Details of the temperature detection sensor 70 will be described later.

The fixing device 40 presses and heats the paper P supplied from the aforementioned image forming unit 20 between the heating roller 41 and the pressing roller 42, thereby fixing the toner image to the paper P. Then, the paper P with the toner image fixed by the fixing device 40 is sent to a downstream side by the aforementioned both rollers 41 and 42. The sent paper P is discharged to the paper discharge unit 50 formed on an upper surface of the casing 60 via the plurality of conveying roller pairs 12 and 13.

Figure 2:
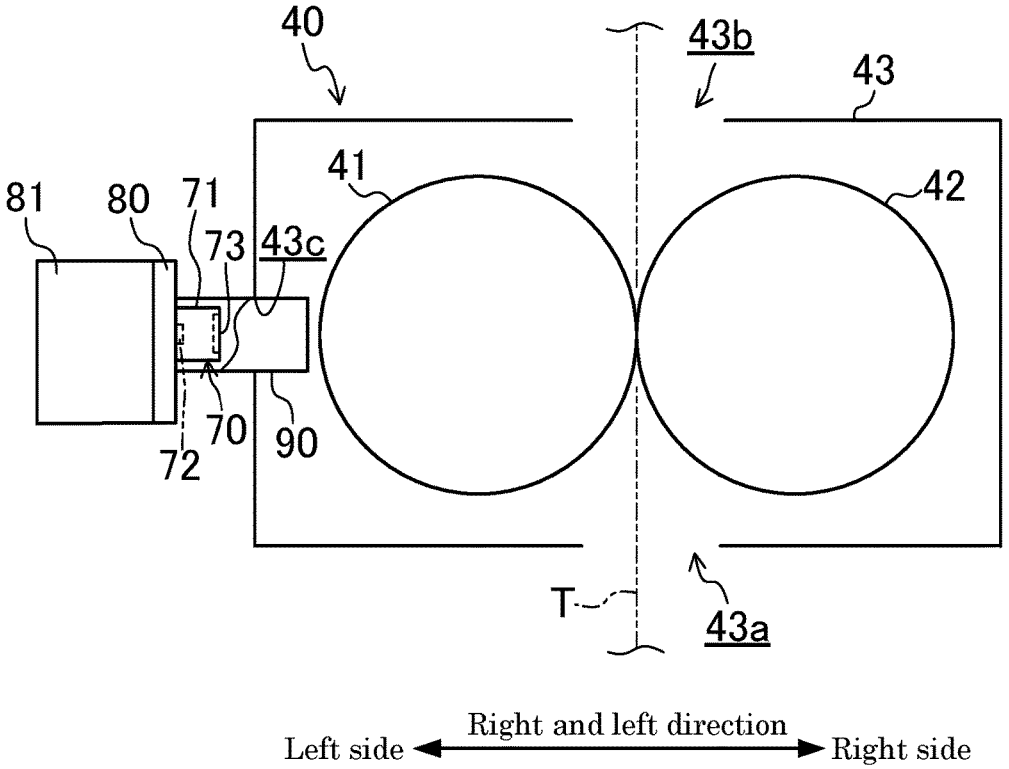
FIG. 2 is an enlarged view of a fixing unit of FIG. 1.
Figure 3:
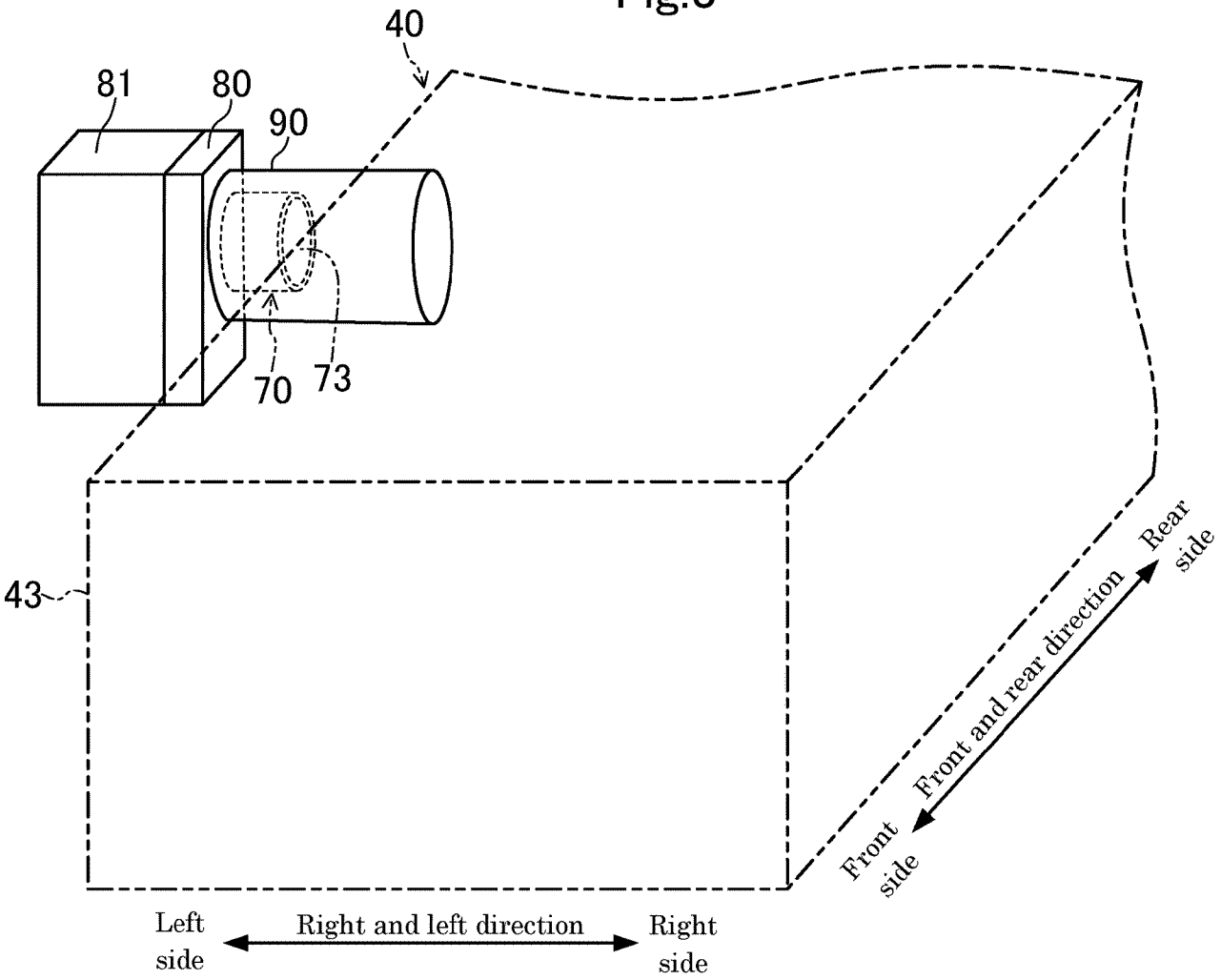
FIG. 3 is a perspective view illustrating a temperature detection sensor covered by a sensor protection tube.

As illustrated in FIG. 2, the heating roller 41 and the pressing roller 42 of the aforementioned fixing device 40 are accommodated and unitized in a housing 43. The housing 43 is formed in an approximately rectangular parallelepiped shape extending in a front and rear direction in a whole view. The housing 43 is detachably mounted at a predetermined place in the casing 60. The housing 43 is formed at a lower wall thereof with a paper introduction port 43*a* and at an upper wall thereof with a paper discharge port 43*b*. The paper P supplied from the image forming unit 20 is introduced into the housing 43 from the paper introduction port 43*a* of the housing 43 and is discharged to an exterior of the housing 43 from the paper discharge port 43*b* after passing through between both rollers 41 and 42.

The housing 43 is formed at a left wall thereof with a through hole 43*c* through which a sensor protection tube 90 passes. The sensor protection tube 90 is a member for protecting the aforementioned temperature detection sensor 70. An outer diameter of the sensor protection tube 90 is approximately equal to a diameter of the through hole 43*c*. Accordingly, the sensor protection tube 90 is fitted into the through hole 43*c* in a slightly press-fitted state.

The aforementioned temperature detection sensor 70 is provided outside the housing 43. The temperature detection sensor 70 has a sensor body 71 having a hollow cylindrical shape. The sensor body 71 has a temperature detection element 72 accommodated therein. The temperature detection element 72, for example, includes a thermopile employing thermoelectromotive force as operational principle, a pyro employing a pyroelectric effect as operational principle, a bolometer employing a temperature change in electric resistance as operational principle, and the like. The temperature detection sensor 70 detects infrared light emitted from the peripheral surface of the heating roller 41, thereby detecting the temperature of the peripheral surface of the heating roller 41. The temperature detection sensor 70 converts the detected temperature into an electrical signal and outputs the electrical signal to a controller (not illustrated). The controller controls the operation of the halogen lamp based on a temperature signal from the temperature detection sensor 70, thereby controlling the temperature of the peripheral surface of the heating roller 41 to preset setting temperature.

One end surface of the aforementioned sensor body 71 in an axial direction abuts the sensor board 80 and is fixed by soldering and the like. The other end surface of the aforementioned sensor body 71 in the axial direction is mounted with a light transmitting window member. The other end surface of the sensor body 71 in the axial direction constitutes an opposed temperature detection surface 73 while being spaced apart from the peripheral surface of the heating roller 41.

A block-like heat sink 81 is connected to a surface of the aforementioned sensor board 80, which is opposite to the side at which the sensor body 71 is fixed. The heat sink 81 has a function of radiating heat from the temperature detection sensor 70. The heat sink 81, for example, is configured by aluminum. The heat sink 81, for example, is formed at the surface thereof with a plurality of grooves (not illustrated) spaced apart from one another while extending in a right and left direction.

The aforementioned sensor protection tube 90 includes a hollow cylindrical body (a cylindrical member in the present embodiment). The sensor protection tube 90, for example, is configured by a resin member (polyethylene terephthalate resin in the present embodiment). The sensor protection tube 90 horizontally extends in the right and left direction and one end thereof in the axial direction abuts a mounting surface of the aforementioned temperature detection sensor 70 on the aforementioned sensor board. One end of the sensor protection tube 90 in the axial direction is formed to surround the periphery of the temperature detection sensor 70 when viewed from the axial direction. Accordingly, the temperature detection sensor 70 is accommodated in a bottomed hollow space formed by the sensor protection tube 90 and the sensor board 80. Preferably, the one end of the sensor protection tube 90 in the axial direction is fixed to a mounting surface of the sensor board 80 by an adhesive and the like. An abutting portion between the one end of the sensor protection tube 90 in the axial direction and the sensor board 80 may be coated with a seal material for preventing dust from entering into the sensor protection tube 90.

On the other hand, the other end of the sensor protection tube 90 in the axial direction is positioned in the vicinity of the peripheral surface of the heating roller in the housing 43. A gap between the other end of the sensor protection tube 90 and the peripheral surface of the heating roller 41, for example, is set to 0.1 mm to 1 mm.

In the image forming apparatus 1 configured as above, since the periphery of the temperature detection sensor 70 is surrounded by the sensor protection tube 90, it is possible to prevent dust such as toner and paper dust from being attached to the temperature detection surface 73 of the sensor protection tube 90. Moreover, since the one end of the sensor protection tube 90 in the axial direction abuts the mounting surface of the temperature detection sensor 70 in the sensor board 80 and is closed, it is possible to suppress dust from entering into the sensor protection tube 90 from one end side of the sensor protection tube 90. Furthermore, the sensor protection tube 90 passes through the wall portion of the housing 43 and the other end thereof in the axial direction is positioned in the housing 43. Herein, the space in the housing 43 is separated from the developing device 27 that scatters a large amount of toner and the paper feeding unit 10 that generates a large amount of paper dust. Consequently, it is possible to reliably suppress dust (toner, paper dust and the like) from entering from the other end side of the sensor protection tube 90. Thus, it is possible to reliably prevent dust from being attached to the temperature detection surface 73 of the temperature detection sensor 70. Furthermore, since the temperature detection sensor 70 and the sensor board 80 are provided outside the housing 43 of the fixing unit 40, the temperature detection sensor 70 is not simultaneously discarded at the time of discard of the fixing unit 40. Consequently, it is advantageous in terms of cost and resource saving. Furthermore, in the case of performing the maintenance of the fixing unit 40, it is not necessary to detach the temperature detection sensor 70 and the sensor board 80 from the casing 60 together with the housing 43. Consequently, it is possible to perform attachment/detachment of the housing 43 without detaching wirings of the temperature detection sensor 70, so that it is possible to easily perform the aforementioned maintenance work.

Preferably, the aforementioned sensor protection tube 90 is configured by a thermal insulation member. As the thermal insulation member, it is possible to employ ceramics with low thermal conductivity for example.

In this way, it is possible to suppress the heat of the heating roller 41 from being transferred to the temperature detection sensor 70 through the wall surface of the sensor protection tube 90. Accordingly, it is possible to suppress temperature detection accuracy from being reduced by an increase in the temperature of the temperature detection sensor 70.

Preferably, the heat sink 81 for radiating heat from the temperature detection sensor 70 is provided at the surface of the aforementioned sensor board 80, which is opposite to the mounting surface of the temperature detection sensor 70.

According to such a configuration, since it is possible to radiate the heat from the temperature detection sensor 70 by the heat sink 81, an excessive increase in the temperature of the temperature detection sensor 70 is suppressed, so that it is possible to suppress the reduction of the temperature detection accuracy by the temperature detection sensor 70.

Furthermore, the other end of the sensor protection tube 90 in the axial direction is positioned in the vicinity of the surface of the heating roller 41. Consequently, a gap between the other end of the sensor protection tube 90 in the axial direction and the surface of the heating roller 41 is minimized, so that it is possible to suppress dust from entering into the sensor protection tube 90 from the gap between the sensor protection tube 90 and the heating roller 41. Accordingly, it is possible to more reliably suppress dust from being attached to the temperature detection surface 73 of the temperature detection sensor 70.

Other Embodiments

In the aforementioned embodiment, a heating means (the halogen lamp in the aforementioned embodiment) for heating the heating roller 41 is provided inside the heating roller 41; however, the technology of the present disclosure is not limited thereto and the aforementioned heating means may also be provided outside the heating roller 41. Furthermore, the heating means is not limited to the halogen lamp, and for example, may also include an induction heating means having an exciting coil and a core.

In the aforementioned embodiment, the sensor protection tube 90 is formed in a cylindrical shape; however, the technology of the present disclosure is not limited thereto and the sensor protection tube 90, for example, may also be formed in a rectangular cylindrical shape or a triangular cylindrical shape.

In the aforementioned embodiment, the shaft line of the sensor protection tube 90 has a straight line shape; however, the technology of the present disclosure is not limited thereto and the shaft line of the sensor protection tube 90 may also have a curved line shape.

In the aforementioned embodiment, the example, in which the image forming apparatus 1 is a printer, has been described; however, the technology of the present disclosure is not limited thereto and the image forming apparatus 1, for example, may also include a copy machine, a facsimile, a multifunctional peripheral and the like.

What is claimed is:

1. An image forming apparatus comprising:

a fixing unit having a heating roller and a pressing roller arranged while interposing a paper conveyance path between the heating roller and the pressing roller, and performing a fixing process on a paper at a fixing nip portion formed by the heating roller and the pressing roller;

a non-contact type temperature detection sensor having a temperature detection surface facing a surface of the heating roller while being spaced apart from the surface of the heating roller; and a sensor board on which the temperature detection sensor is mounted, wherein the fixing unit includes a housing that has the heating roller and the pressing roller accommodated therein, the temperature detection sensor and the sensor board are provided outside the housing, and the image forming apparatus further comprises:

a sensor protection tube including a hollow cylindrical body passing through a side wall portion of the housing, and having one end that abuts a mounting surface of the temperature detection sensor in the sensor board so as to surround a periphery of the temperature detection sensor and the other end positioned in the housing and in vicinity of a surface of the heating roller, wherein a heat sink for radiating heat from the temperature detection sensor is provided at a surface of the sensor board, which is opposite to the mounting surface of the temperature detection sensor.

2. The image forming apparatus of claim 1, wherein the sensor protection tube is configured by a thermal insulation material.

3. The image forming apparatus of claim 1, wherein the image forming apparatus comprises:

a casing that has an image forming unit accommodated therein, and wherein the housing of the fixing unit is detachably mounted at a predetermined place in the casing.

4. The image forming apparatus of claim 1, wherein the temperature detection sensor is formed by the sensor protection tube and the sensor board, and is accommodated in a hollow space.

* * * * *